United States Patent [19]

Haberrecker

[11] Patent Number: 4,631,744

[45] Date of Patent: Dec. 23, 1986

[54] X-RAY TUBE

[75] Inventor: Klaus Haberrecker, Bubenreuth, Fed. Rep. of Germany

[73] Assignee: Siemens Aktiengesellschaft, Berlin and Munich, Fed. Rep. of Germany

[21] Appl. No.: 673,737

[22] Filed: Nov. 21, 1984

[30] Foreign Application Priority Data

Nov. 25, 1983 [DE] Fed. Rep. of Germany ..... 3342688

[51] Int. Cl.[4] ..... H01J 35/06; H01J 35/26

[52] U.S. Cl. ..... 378/138; 378/142

[58] Field of Search ..... 378/138, 136, 125, 142, 378/127

[56] References Cited

U.S. PATENT DOCUMENTS

| | | | |
|---|---|---|---|
| 2,686,884 | 8/1954 | Atlee | 378/138 |
| 2,839,698 | 6/1958 | Bell | 313/55 |
| 3,433,955 | 3/1969 | Perry | 250/90 |
| 3,875,028 | 4/1975 | Atlee et al. | 204/37 |
| 3,962,583 | 6/1976 | Holland et al. | 250/402 |
| 4,184,097 | 1/1980 | Auge | 313/55 |

OTHER PUBLICATIONS

Hoselitz, K., *Ferromagnetic Properties of Metals and Alloys*, Clarendon Press, Oxford, 1952, Table XIV.

German DIN Specification 17 440, "Stainless Steels; Quality Specifications".

*Primary Examiner*—Craig E. Church

*Assistant Examiner*—T. N. Grigsby

*Attorney, Agent, or Firm*—Hill, Van Santen, Steadman & Simpson

[57] ABSTRACT

An x-ray tube has a cathode head for focusing an electron beam directed at an anode. The cathode head is made of ferromagnetic material having a Curie point above 700° C. and is mounted on a supporting element to the tube envelope via a direct metallic connection in the form of soldering or welding. The combination of the high Curie point and the direct metallic connection provide good heat transfer such that the Curie point is not exceeded so that the cathode head always remains ferromagnetic. The cathode head thus always operates in a predictable manner and no movement of the focus by magnetic fields occurs.

12 Claims, 3 Drawing Figures

X-RAY TUBE

BACKGROUND OF THE INVENTION

1. Field of the Invention

The present invention relates to x-ray tubes, and in particular to an x-ray tube having a cathode head containing an electron source mounted on a supporting element opposite and anode.

2. Description of the Prior Art

An x-ray tube having a cathode head with a thermionic coil or filament contained in a recess of the cathode head for directing an electron beam at an anode is disclosed in U.S. Pat. No. 3,433,955. This x-ray tube is typical of conventional x-ray tubes wherein the electron beam issuing from the cathode in the form of a filament is directed by means of a focusing device such as a focusing cup or Wehnelt cylinder, to the focal spot on the anode. The thermionic cathode generally consists of a wire wound in the form of a helical spring or coil. In order to focus the electron beam, the thermionic cathode generally is disposed with a recess of the metallic cathode head, the recess being at the same potential as the cathode head. The electron beam is thus held together and shaped in a desired manner.

In particular, for rotary anode x-ray tubes, a rectangular focal spot is generated which originates from the thermionic coil which is disposed in a groove-like recess of the cathode head. As described in the aforementioned U.S. Pat. No. 3,433,955, the anode structure consists of nickel or similar material.

A problem in the design of such x-ray tubes is to achieve improved focusing, in particular in the case of small focal spots, and to increase the focus stability during operation.

SUMMARY OF THE INVENTION

It is an object of the present invention to provide an x-ray tube having a thermionic cathode mounted on a cathode head which generates a small focal spot on an anode.

It is further object of the present invention to provide such an x-ray tube wherein the focal spot on the anode is stable, i.e., does not appreciably move, during operation.

The above objects are inventively achieved in an x-ray tube wherein the cathode consists of ferromagnetic material having a Curie point which is above 700° C., and which is directly metallically connected to the surrounding support.

By the use of ferromagnetic material having a Curie point above 700° C., improved focusing results because magnetic fields which may otherwise cause movement of the electron beam, and thus movement of the focal spot, do not arise, even at the operating temperature of the cathode. The cathode head may be comprised, for example, of high-grade steel which makes connection of the cathode parts by welding or soldering more feasible. The thermally conducting contact of the cathode parts with one another is thereby substantially improved, so that heat is better distributed compared with conventional cathodes and no overheating occurs.

During operation of an x-ray tube, the cathode head in conventional tubes may reach a temperature of 800° to 850° C. In tubes having a metallic hub, the heating through the coil combined with reflected heat from the anode during operation may reach 1000° C. or more. If the cathode head is comprised of nickel or ferromagnetic high-grade steel, the ferromagnetism is lost. In the case of nickel with a Curie temperature of 370° C., the ferromagnetism is lost considerably earlier. By the construction disclosed and claimed herein, however, which permits a welded or soldered connection, the temperature of the cathode head is reduced by approximately 150° C. so that high-grade ferromagnetic steel can be utilized with its Curie point no longer being exceeded. Because the ferromagnetism is retained, no movement of the focal spot as a result of magnetic fields acting on the electron beam or the remainder of the tube occurs. This is particularly advantageous in the case of x-ray tubes because such magnetic fields can cause movement of a small focal spot by an amount approximately equal to the size of the spot itself.

DESCRIPTION OF THE PREFERRED EMBODIMENTS

Figure 1:
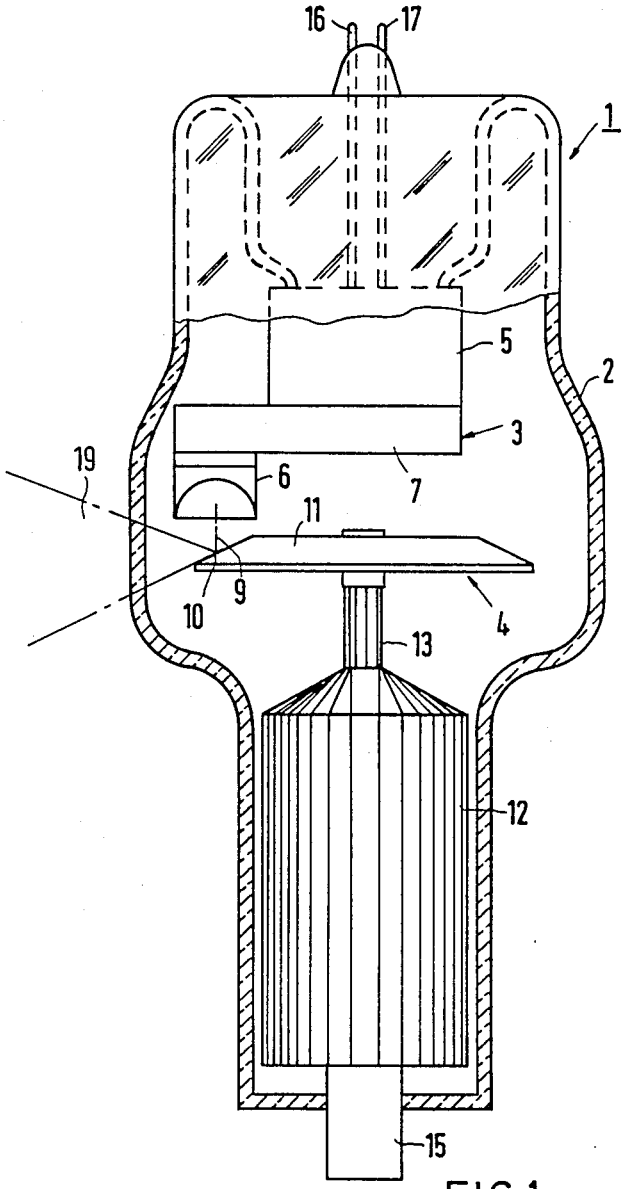
FIG. 1 is a side view, partly in secton, of an x-ray tube constructed in accordance with the principles of the present invention.
Figure 2:
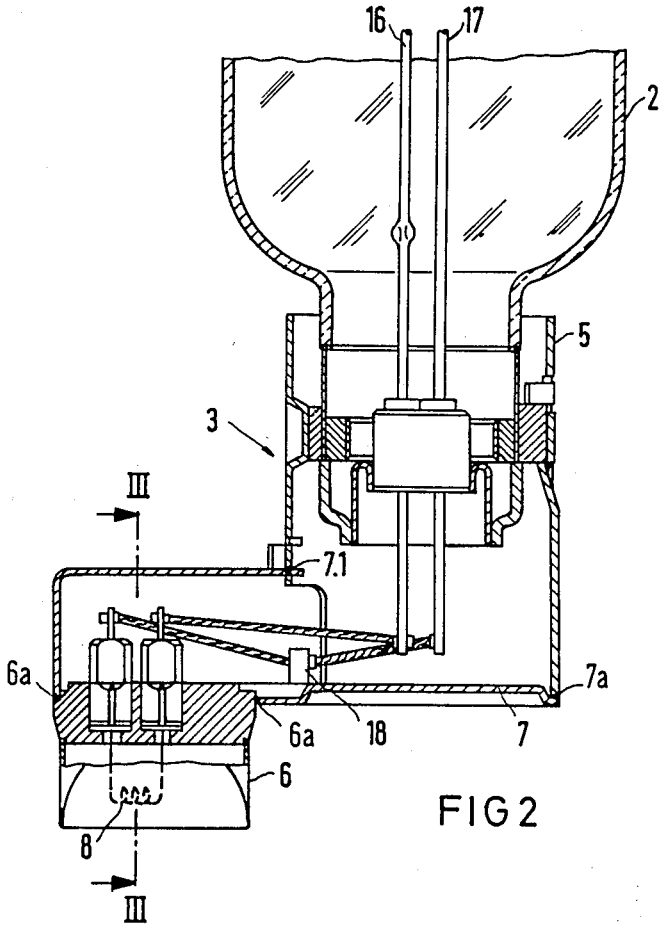
FIG. 2 is a sectional view of the cathode head for the x-ray tube shown in FIG. 1 constructed in accordance with the principles of the present invention.
Figure 3:
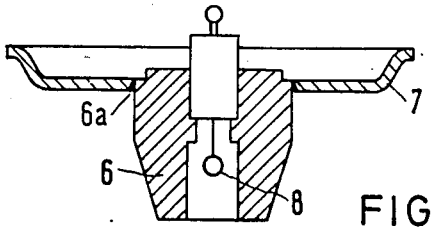
FIG. 3 is a sectional view taken along line III—III of FIG. 2.

An x-ray tube constructed in accordance with the principles of the present invention is generally references at 1 in FIG. 1. The x-ray tube 1 includes an envelope 2, a cathode 3 and an anode 4. The cathode consists of a cathode head 6 attached to an intermediate support 7, which is in turn attached to a cathode mount 5. The cathode 3 also includes a thermionic coil 8 (shown in FIGS. 2 and 3) disposed in a recess in the cathode head 6.

The anode 4 consists of a rotary anode plate 11 supported on a shaft 13 which extends through a rotor 12. The anode plate 11 is rotated about the shaft 13 in a known fashion by means of a stator (not shown).

The thermionic coil 8 generates an electron beam 9 which is incident on a focal spot 10 on the anode plate 11, and generates an x-ray beam 19. The operating voltage for the x-ray tube 1 is applied between a connector 15 and one of lines 16 or 17. The supply voltage for the thermionic coil 8 is applied across lines 16 and 17. The cathode head 6 is also supplied with the cathode voltage through a connector 18 on the intermediate support 7 such that the electrons in the electron beam 9 issuing from the thermionic coil 8 are focused in a known manner on the anode plate 11.

The cathode head 6 is attached to the intermediate support 7 at locations **6*a* by a direct metallic connection, such as by welding, and the intermediate support 7 is attached to the cathode mount 5 at locations 7*a* also by a direct metallic connection, such as by soldering. The cathode head consists of a ferromagnetic material having a Curie point above 700° C., and by the direct metallic attachment of the cathode head 6 and the intermediate support 7 and the cathode mount 5, good thermal conducting properties are achieved such that the operating temperature of the cathode head remains substantially below the Curie temperature. The electron beam 9 issuing from the cathode filament 8 is thus not subjected to varying magnetic fields, and always remains focused at the same focal spot 10** during operation.

The cathode head 6, as stated above, consists of ferromagnetic material having a Curie point above 700° C., such as high-grade steel. A suitable high-grade steel is commercially available under the designation "Remanit 4006" or "4016". The specifications for this material are found in "DIN 17440," addition 12.72, as material number 1.4006, or abbreviated by the designation X 10 Cr 13, and is a steel containing 0.08 to 0.12% carbon and 12 to 14% chromium. Remanit 4016 is described in the above DIN addition as material number 1.4016 with the designation X 8 Cr 17, and is a steel having more than 0.1% carbon and 15.5 to 17.5% chromium.

Utilization of high-grade steel of the type described above in the x-ray tube 1 is also preferable because a favorable transition to Vacon 10 is achieved. Vacon 10 is generally utilized for fusing glass and ceramic material, Vacon 10 being a so-called fusion or smelting alloy whose primary constituents, in addition to iron, are 28% nickel, and 18% cobalt. The thermal expansion behavior of the above-described high-grade steel is better matched to that of this alloy than is the case with, for example, nickel. The other components of the cathode 3, namely the intermediate support 7 and the cathode mount 5 may also consist of the same type of high-grade steel, such as Remanit 4006 or Remanit 4016.

Although modifications and changes may be suggested by those skilled in the art it is the intention of the inventor to embody within the patent warranted hereon all changes and modifications as reasonably and properly come within the scope of his contribution to the art.

I claim as my invention:

1. In an x-ray tube having an envelope containing a cathode and an anode, said cathode having a cathode head and a support means for said cathode head and an electron source disposed within said cathode head, the improvement comprising a cathode head consisting of ferromagnetic material having a Curie point greater than 700° C., and said cathode head being soldered to said support means.

2. The improvement of claim 1 wherein said cathode head is comprised of ferromagnetic high-grade steel.

3. The improvement of claim 1 wherein said cathode is comprised of high-grade steel having, in addition to iron, carbon in the range of approximately 0.08 to approximately 0.12% and having chromium in the range of approximately 12 to approximately 14%.

4. The improvement of claim 1 wherein said cathode head is comprised of high-grade steel having, in addition to iron, carbon in an amount greater than approximately 0.1% and chromium in a range of approximately 15.5 to approximately 17.5%.

5. In an x-ray tube having an envelope containing a cathode and an anode, said cathode having a cathode head and a support means for said cathode head and an electron source disposed within said cathode head, the improvement comprising a cathode head consisting of ferromagnetic material having a Curie point greater than 700° C., and said cathode head being welded to said support means.

6. The improvement of claim 5, wherein said cathode head is comprised of ferromagnetic high-grade steel.

7. The improvement of claim 5, wherein said cathode is comprised of high-grade steel having, in addition to iron, carbon in the range of approximately 0.08 to 0.12% and chromium in the range of approximately 12 to approximately 14%.

8. The improvement of claim 5, wherein said cathode head is comprised of high-grade steel having, in addition to iron, carbon in an amount greater than approximately 0.1% and chromium in a range of approximately 15.5 to approximately 17.5%.

9. In an x-ray tube having an envelope containing a cathode and an anode, said cathode having a cathode head and a support means for said cathode head and an electron source disposed within said cathode head, the improvement comprising a cathode head consisting of ferromagnetic material having a Curie point greater than 700° C., said support means having an intermediate support directly mechanically connected to said cathode head and a cathode mount connected to said intermediate support, said intermediate support consisting of high-grade steel having, in addition to iron, carbon in the range of approximately 0.08 to approximately 0.12% and chromium in the range of approximately 12 to approximately 17.5%.

10. In an x-ray tube having an envelope containing a cathode and an anode, said cathode having a cathode head and a support means for said cathode head and an electron source disposed within said cathode head, the improvement comprising a cathode head consisting of ferromagnetic material having a Curie point greater than 700° C., said support means having an intermediate support directly mechanically connected to said cathode head and a cathode mount connected to said intermediate support, said intermediate support consisting of high-grade steel having, in addition to iron, carbon in an amount greater than approximately 0.1% and chromium in a range of approximately 15.5 to approximately 17.5%.

11. In an x-ray tube having an envelope containing a cathode and an anode, said cathode having a cathode head and a support means for said cathode head and an electron source disposed within said cathode head, the improvement comprising a cathode head consisting of ferromagnetic material having a Curie point greater than 700° C., said support means having an intermediate support directly mechanically connected to said cathode head and a cathode mount connected to said intermediate support, said cathode mount consisting of high-grade steel having, in addition to iron, carbon in the range of approximately 0.08 to approximately 0.12% and chromium in the range of approximately 12 to approximately 17.5%.

12. In an x-ray tube having an envelope containing a cathode and an anode, said cathode having a cathode head and a support means for said cathode head and an electron source disposed within said cathode head, the improvement comprising a cathode head consisting of ferromagnetic material having a Curie point greater than 700° C., said support means having an intermediate support directly mechanically connected to said cathode head and a cathode mount connected to said intermediate supprot, said cathode mount consisting of high-grade steel having, in addition to iron, carbon in an amount greater than approximately 0.1% and chromium in a range of approximately 15.5 to approximately 17.5%.

* * * * *